US007827884B2

(12) United States Patent
Lawson

(10) Patent No.: US 7,827,884 B2
(45) Date of Patent: Nov. 9, 2010

(54) BEVERAGE KEY

(76) Inventor: Robert Gene Lawson, HC 69 Box 168-E1, 1338 Holloway Ridge Rd., Spring City, TN (US) 37381

( * ) Notice: Subject to any disclaimer, the term of this patent is extended or adjusted under 35 U.S.C. 154(b) by 315 days.

(21) Appl. No.: 11/654,710

(22) Filed: Jan. 19, 2007

(65) Prior Publication Data

US 2008/0173134 A1 Jul. 24, 2008

(51) Int. Cl.
*B67B 7/44* (2006.01)

(52) U.S. Cl. ..... 81/3.09

(58) Field of Classification Search ..... 81/3.09, 81/3.55, 3.57; D8/18, 19, 43; 7/151
See application file for complete search history.

(56) References Cited

U.S. PATENT DOCUMENTS

| | | | | | |
|---|---|---|---|---|---|
| 1,299,974 | A | * | 4/1919 | Lorenz et al. | 215/270 |
| 4,409,863 | A | * | 10/1983 | Anderson | 81/3.09 |
| 4,463,631 | A | * | 8/1984 | Barnes et al. | 81/3.09 |
| 4,617,842 | A | * | 10/1986 | Yang | 81/3.09 |
| 4,864,898 | A | * | 9/1989 | Tricinella | 81/3.09 |
| 4,949,600 | A | * | 8/1990 | Tricinella | 81/3.09 |
| D311,667 | S | * | 10/1990 | Cholagh | D8/18 |
| 4,979,407 | A | * | 12/1990 | Hernandez et al. | 81/3.09 |
| 5,535,644 | A | * | 7/1996 | Paul-Alexandre et al. | 81/3.09 |
| D382,453 | S | * | 8/1997 | Drinkwater | D8/40 |
| 5,771,759 | A | * | 6/1998 | Warren | 81/3.09 |
| D447,675 | S | * | 9/2001 | Vaught | D8/38 |
| 6,752,040 | B1 | * | 6/2004 | Paul-Alexandre et al. | 81/3.09 |
| 7,004,049 | B2 | * | 2/2006 | So et al. | 81/3.09 |
| D538,117 | S | * | 3/2007 | Lin | D8/18 |
| 2005/0076742 | A1 | * | 4/2005 | Yurek et al. | 81/3.55 |
| 2005/0252343 | A1 | * | 11/2005 | Turner | 81/3.09 |

* cited by examiner

*Primary Examiner*—David B Thomas
(74) *Attorney, Agent, or Firm*—Davis & Bujold, P.L.L.C.

(57) ABSTRACT

An opening location marker for pop-top cans in combination with an improved opener for both pop-top cans and bottles is formed to include an elongated lever body. A lifting element is positioned on the lever body and is sized shaped to fit underneath the lift tab on a pop-top can. A dent making element comprising an elongated fulcrum element is further formed on the lever body in physical association with the lift element but spaced away from the lift element so as to form a channel between the lift element and the fulcrum element. The channel is sized and shaped such that the lift tab of the pop-top can be sheaved in the channel between the lift element and the fulcrum element for manipulation of the lift tab to open the pop-top can. The opener further includes an edge gripper located on the lever body in physical association with the elongated fulcrum element. For marking the location of the opening on pop-top cans, the edge gripper is positioned on the pop-top can so that it engages the inside edge of the top of the pop-top can at the site of opening such that when the device is rotated the elongated fulcrum element may impact and "dent" the side of the pop top can. For removing bottle caps from capped bottles, the edge gripper is positioned on the opener such that it engages the edge of the bottle cap when the elongated fulcrum element is positioned in the center of the bottle cap.

1 Claim, 1 Drawing Sheet

BEVERAGE KEY

BACKGROUND OF THE INVENTION

This invention is directed to an opening location marker for pop-top cans in combination with an improved opener for both pop-top cans and bottles. The improved "beverage-key" of the invention is not only capable of opening either capped bottles or pop-top cans of the type having a lift tab but of indicating the location of the opened spout of pop-top cans by making an easily locatable (i.e. tactily discoverable) and permanent "dent" in the side of the pop-top can below and adjacent to the opened spout.

It is generally known that two of the most popular ways of dispensing individual servings of beverages are in pop-top beverage cans and capped bottles. A modern pop-top beverage can utilizes a lift tab which is permanently attached to the lid of the can. In lifting the tab, an end of the tab depresses a section of the top of the can which is scored on three sides. The end of the tab presses the scored area inwardly into the can to form an opening in the can. Once the can has been opened the tab is bent back flat and flush against the top of the can allowing the contents of the can to either be poured out or to be removed from the can by drinking directly from the can. While the above described pop-top cans are very convenient, certain individuals have difficulty in opening them and must use some sort of implement assistance in order to lift the tab successfully.

Individual capped bottles of beverages generally are bottled in either a bottle which has a lift off cap which must be removed with an opener, or a screw off cap which theoretically can be removed by twisting off the top of the bottle. It goes without saying that the caps designed to be removed with an opener or other implement cannot be opened without that implement.

A variety of openers suitable for removing the caps on bottles and opening pop-top cans are known and used. These combination bottle cap/pop-top can openers however have little utility in marking/indicating the location of the opening on pop-top cans.

It is the extreme convenience and ease of use of the pop-top can that has made them ubiquitous in modern society an that, in turn has given rise to the need for an opening location marker. Almost all modern vehicles are fitted with beverage-holding accessories. Many states have passed or are developing new motor vehicle regulations prohibiting vehicle operators from engaging in activities which distract attention from operation of the motor vehicle. The opening location marker of this invention allows a vehicle operator to locate the spout of an opened pop-top can without the need to divert attention from the operation of the vehicle.

The opening location marker also serves as a beverage identifier in public places/gatherings where all pop-top cans o certain brand look identical. A "dented" beverage is easily distinguished from other non-"dented" pop-top cans. This provides a benefit not only in identification of beverage ownership but in the prevention of the transmission of disease.

Finally, provision of a pop-top can opening location marker in combination with an improved opener for both pop-top cans and bottles according to the present invention will maximize utility and ease-of-use for the user.

BRIEF DESCRIPTION OF THE INVENTION

From the above it is evident that there exists a need for new and improved tools for assisting in opening and use of pop-top cans. Further, it is evident that there exists a need for new and improved tools which can be used for both opening and locating the opening for pop-top cans and removing caps from capped bottles. In view of this it is a broad object this invention to provide for a combination pop-top can opener, opening locater and bottle opener. It is an additional object of this invention to provide for openers and opener locaters of the type described above which are designed and engineered for the convenience of the user but still are capable of a long and useful lifetime.

These and other objects as will become evident from the remainder of this specification are achieved in a combination pop-top can opener, opening location marker and bottle opener which includes a lever body having a lift means for fitting underneath a pop-top can lift tab on a pop-top can. Further, an elongated fulcrum means is formed on the body in physical association with the lifting means. The elongated fulcrum means is for engaging the top of a bottle cap, one surface of the pop-top lift tab or the side of a pop-top can. Together the elongated fulcrum means and the lifting means define a channel formed as an opening between the elongated fulcrum means and the lifting means. The channel is capable of sheaving or enveloping the lift tab of the pop-top can to interleave the pop-top lift tab between the lifting means and the elongated fulcrum means. A combination bottle cap edge/pop-top can edge gripper is further located on lever body in physical association with the elongated fulcrum means. Together the combination bottle cap edge/pop-top can edge gripper and the elongated fulcrum means are utilized to remove a cap from a bottle or to dent the side of a pop-top can.

Preferably the device is formed of unibody construction. The device may be formed of a very stiff resilient polymeric material as, for instance polycarbonate, a fiber impregnated polyamide, polymeric material or metal.

BRIEF DESCRIPTION OF THE DRAWINGS

This invention can be better understood when taken in conjunction with the figures wherein.

This invention utilizes certain principles and/or concepts as are set forth in the claim appended hereto. Those skilled in the package and utensil arts will realize that these principles and/or concepts are capable of being utilized by a embodiments which may differ from the exact embodiments used for illustrative purposes herein. For this reason this invention is not to be construed as being limited solely to the illustrative embodiments, but should only be construed in view of the claims appended hereto.

DETAILED DESCRIPTION OF THE INVENTION

Figure 5:
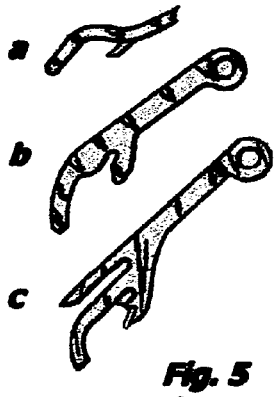
Fig. 5 Prior Art
FIG. 5 is a side elevational view of first, second and third prior art bottle cap removers.

FIG. 5*a* illustrates one end of a widely used bottle cap opener. This opener is formed on one end of a steel implement which may include a can opener on its other end. A tang is punched from the center of the implement and bent inward from the plane of the implement. This opener features no means for engaging a pop-top can lift tab let alone a reliable means for marking the location of its spout. Further, this opener can rust and may not be carried on a key ring nor easily in a pocket.

FIG. 5*b* illustrates a combination bottle opener and pop-top can tab lifter formed of unibody construction that is designed to be used on a key ring. This opener is formed typically of annodized aluminum as such does not rust as does the above opener; however, because it is made from aluminum the edges of the steel bottle caps it is used to remove soon degrade it, rendering it useless as well as potentially dangerous. The shallow notch for engaging a pop-top can lift tab is located in that area of the opener which tends to be abraded by opening bottles. As this area wears, the opener becomes less effective in assisting in opening pop-top cans. No means for marking the location of the opening for a pop-top can is provided.

FIG. 5*c* illustrates a combination bottle opener and pop-top can tab lifter not formed of unibody construction that is designed to be used on a key ring. Like the devices in FIGS. 5*a* and 5*b* it is a so-called "beverage-wrench that features longitudinal and lateral extension in a plane that is transverse/orthogonal to the plane of its operation. Because the device in 5*c* is made mostly of a polymer (with the exception of the bottle cap gripping element) it is flimsy. Because is relatively wide it does not fit well on a key ring. It has never been adequate as a bottle opener because its flat bottle cap gripping element easily slips from the edge of a bottle cap. The device in FIG. 5*c* is not capable of marking the opening location on a pop-top can.

A combination pop-top can opener and opening location marker and bottle opener 10 of the invention is capable of opening and marking the opening location of a pop-top can and removing the cap from a capped bottle. The opener 10 is formed of one piece.

The device 10 is formed as a unified structure from a suitable material that is incapable of bending or breaking during use. Suitable for forming the device 10 would be a polypeptide such as nylon or a polycarbonate. Many commercial formulations of polymeric materials are available for use with injection molds. A variety of metals may also be used and the device 10 may be stamped from sheets thereof.

The device 10 has a handle portion 12 which includes an eye 14 allowing for attachment of the device 10 to a key ring, a chain or the like to assist in maintaining the device 10 easily accessible to the user.

Extending from the handle 14 is a lift element 16. The lift element 16 includes a wedge surface 18 on its end.

Device 10 is formed of a curvilinear, elongated lever continuing into the lift element 16. As such the lift element 16 formed as an elongated surface which is capable of sliding underneath the lift tab of a pop-top can. The wedge surface 18 assists in positioning of the lift element 16 underneath the lift tab of the pop-top can.

An elongated fulcrum element 20 is formed on the device 10 adjacent to the lift element 16. A first portion of the fulcrum element, a straight portion 22 extends essentially parallel to the lift element 16. The elongated fulcrum element 20 then curves in an arcuate portion 24 away from the lift element 16. The end of the arcuate portion 24 culminates in engagement end 26 which fits against the side of a pop-top can when device 10 is utilized to dent it in order to indicate the location of the opened spout or against the center top of a cap when the device 10 is utilized to open bottles.

The elongated fulcrum element 20 and the lift element 16 are spaced apart from one another forming a channel 28 between them. The channel 28 is thus formed as an opening in the device 10. The inside walls of the channel 28 are parallel to one another and are spaced apart from one another a distance sufficient to allow for positioning or sheaving of the lift tab of a pop-top can between the lift element 16 and the elongated fulcrum element 20 within the channel 28. Because the lift tabs of a pop-top can are flat planar structures and because the channel 28 is essentially formed as a flat opening the flat planar lift tab is snugly engaged, enveloped or sheaved within the channel 28 once the I& element 16 is slid underneath the lift tab.

Figure 3:
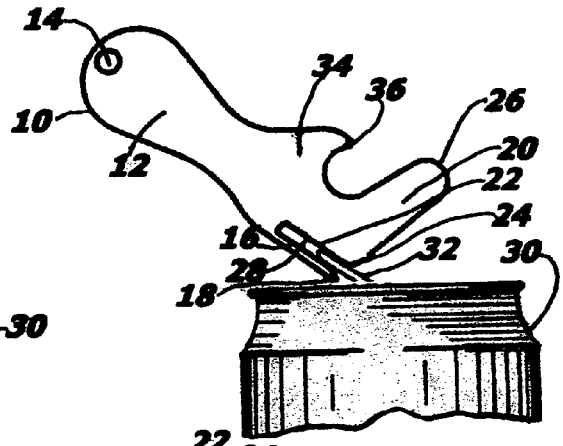
FIG. 3 is a side elevational view of a combination opening location marker, pop-top can and bottle opener of the invention showing the use of the device in opening a pop-top can.

In FIG. 3 a device 10 of the invention is being utilized to open a pop-top can 30. To open the can 30 the lift 16 element is slid underneath the lift tab 32 of the can 30. The wedge surface 18 assists in initially raising the lift tab 32 from the top surface of the can 30. Once the lift tab 32 is positioned in the channel 28 between the lift element 16 and the elongated fulcrum element 20, the device 10 is then rotated to lift the lift tab 32 and rotate it with respect to the top of the can 30 to open the can 30. Because the channel 28 is deep, of a dimension sufficient to sheave almost all of the lift tab 32 within it, the lift tab 32 will not slip or slide out of the channel 28. This prevents breaking off of the tab as may happen if the tab is twisted improperly by hand or with other implements. If the tab is broken off the can prior to opening the can, of course the contents of the can are unattainable.

Also, because the user of the can 30 does not have to initially pry the lift tab 32 from the surface of the can 30, the fingernails of the user are not in jeopardy of being broken and because of the mechanical advantage achieved with the device 10, children and other individuals with weak or diseased hands can effectively open the pop-top can 30 with ease.

Figure 1:
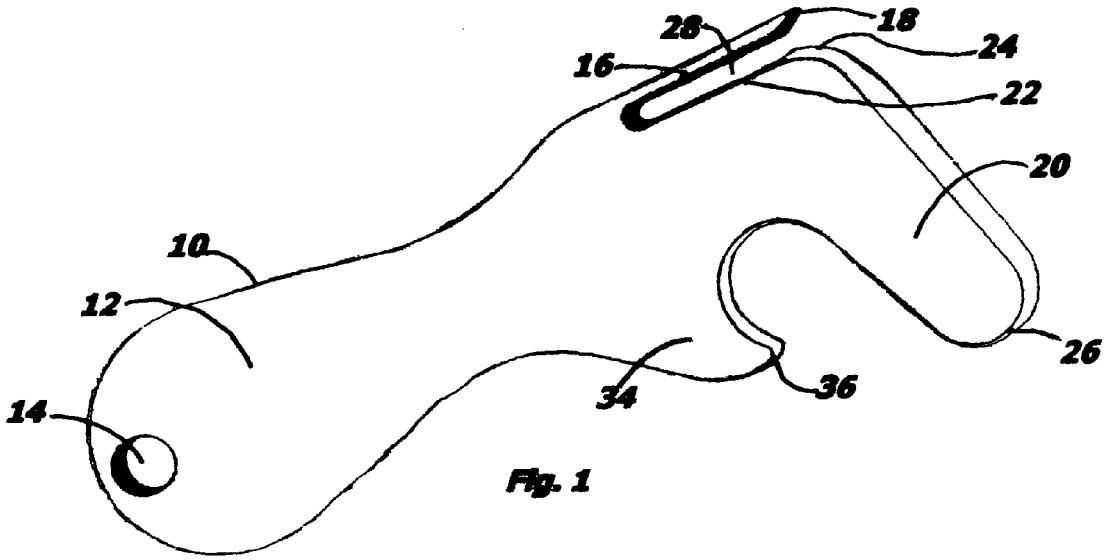
FIG. 1 is an exploded isometric view of a combination opening location marker, pop-top can and bottle opener of the invention showing the side, bottom and front of this opener.
Figure 2:
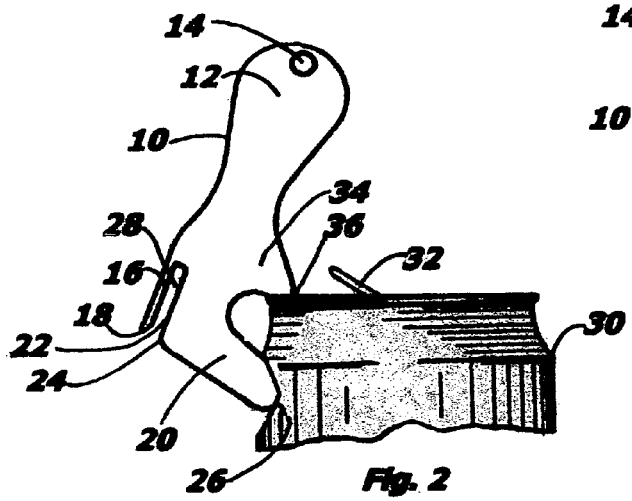
FIG. 2 is a side elevational view of a combination opening location marker, pop-top can and bottle opener of the invention showing the use of the device in marking the location of the opening on a pop-top can.

In FIG. 2 a device 10 of the invention is being utilized to mark the location of the opening of pop-top can 30. To mark the opening of can 30 the claw 36 is placed at the indent of the inside rim of can 30 adjacent to the opening of can 30. Rotation of the device 10 in the normal manner dents the can when the elongated fulcrum element 20 impacts the side of can 30 and thereby marks the location of the opening of pop-top can 30.

For marking the side of cans and for opening bottles, in combination with the elongated fulcrum element 20, the device 10 includes an edge gripping plate foundation area 34. The foundation area 34 is formed as a projection of the device 10 which extends away from the elongated axis of the device 10. The area 34 includes a bottom claw 36 which is adapted to fit into the inside edge of the top of a pop-top can 30 or under the edge of a bottle cap 40

Figure 4:
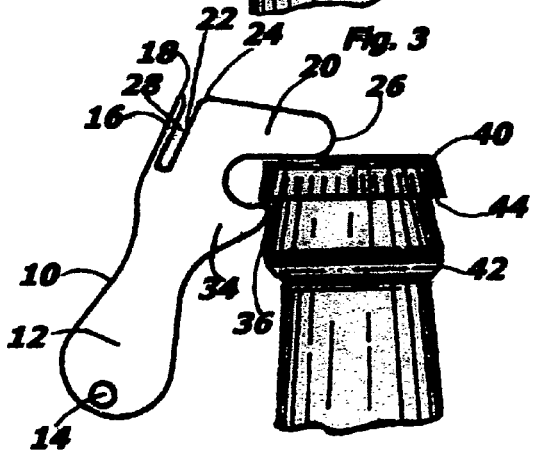
FIG. 4 is a side elevational view of a combination opening location marker, pop-top can and bottle opener of the invention showing the use of the device in removing a bottle cap from a capped bottle.

In FIG. 4 the device 10 of the invention is being utilized to remove a cap 40 from a bottle 42. To do so the claw 36 located underneath the lip 44 of the cap 40 and the end of the elongated fulcrum element 20 is positioned on top of cap 40. Rotation of the device 10 in a normal manner lifts the cap 40 from the bottle 42.

As so formed and constructed the device 10 of the invention is utilitarian for opening and marking the location of the opening of pop-top beverage cans and for opening capped beverage bottles. Because the device 10 is formed of unibody construction and is extended both longitudinally and laterally in the plane of its operation it is both strong and lightweight and does not require assembly.

Since the opener 10 is both small in size and does not have any sharp or protruding edges it can be conveniently carried on a key ring in a pocket or purse without fear of either injury to one's body or one's clothing, purse or the like. The thinner, improved structure of the device of the invention means that it is a safer, more convenient and "complete" beverage tool.

What is claimed is:

1. A combination pop-top can opener, opening location dent marker and bottle opener which comprises a lever body formed as a unitary elongated, planar body;

a pop-top can tag lifting means for fitting underneath a pop-top can lift tab on a pop-top can, said lifting means formed as an elongated portion of said unitary lever body;

said pop-top can tag lifting means including a wedge surface means for fitting between a pop-top can lift tab and the top surface of said pop-top can and a channel means formed as an opening between said pop-top can tag lifting means and a first straight section of an elongated fulcrum means;

the elongated fulcrum means being formed as an elongated portion of said unitary lever body located in a parallel planar association with said lifting means and the first straight section of said fulcrum means and extending parallel to said pop-top can tab lifting means;

the elongated fulcrum means including a second straight section extending at an angle to said first straight section and away from the pop-top can tag lifting means, an arcuate section joining said first straight section to said second straight section, and, a can marking engagement end located at an end of the second straight section distant from the pop-top can tag lifting means, the can marking engagement end having a generally curved forming surface having an extent generally equal to a thickness of the lever body extending in a direction generally perpendicular to a plane defined by the lever body and an extent of the can marking engagement end in the plane of the lever body defined by a continuous curve shaped to deform a material of a side of a can into a depressed form without piercing the material of the side of the can when brought into engagement with the side of the can; and an edge gripper for gripping one of the inside edge of the top of a pop-top can and an edge of a bottle cap, said edge gripper being formed integrally with said elongated lever body and in physical association with said elongated fulcrum means-with said arcuate section of said elongated fulcrum means curving away from said lifting means and towards said edge gripper, wherein an extent of the lever body in the plane of the lever body including the second straight section of the elongated fulcrum means, the can marking engagement end and the edge gripper is defined by a continuous smooth curve having no angular protrusions, whereby engagement of said edge gripper with the inside edge of the top of a pop-top can and rotation of the lever body about the edge gripper in a direction toward a side of the can will bring the forming surface of the can marking engagement end of the elongated fulcrum means into contact with the side of the can to form a depression into the material of the side of the can without piercing the material of the side of the can.

* * * * *